US007341438B2

(12) United States Patent
Uno et al.

(10) Patent No.: US 7,341,438 B2
(45) Date of Patent: Mar. 11, 2008

(54) SCROLL-TYPE FLUID MACHINE INCLUDING PASSAGE FORMED IN MOVABLE SCROLL

(75) Inventors: Keiichi Uno, Kariya (JP); Yasuhiro Takeuchi, Kariya (JP); Hironori Asa, Okazaki (JP); Hiroshi Ogawa, Nagoya (JP)

(73) Assignees: DENSO CORPORATION, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 11/367,317

(22) Filed: Mar. 6, 2006

(65) Prior Publication Data

US 2006/0198747 A1 Sep. 7, 2006

(30) Foreign Application Priority Data

Mar. 4, 2005 (JP) ..... 2005-061430

(51) Int. Cl.
*F03C 2/00* (2006.01)
*F04C 18/00* (2006.01)

(52) U.S. Cl. ..... 418/55.2; 418/55.1; 418/183; 418/188

(58) Field of Classification Search ..... 418/55.1, 418/55.2, 183, 188
See application file for complete search history.

(56) References Cited

U.S. PATENT DOCUMENTS 4,886,434 A * 12/1989 Satow et al. ..... 418/55.2
5,370,512 A * 12/1994 Fujitani et al. ..... 418/55.2
5,427,513 A * 6/1995 Yamada et al. ..... 418/55.2
6,113,372 A * 9/2000 Lifson et al. ..... 418/55.2
2005/0220646 A1 10/2005 Ogawa et al.

FOREIGN PATENT DOCUMENTS

JP 58135393 A * 8/1983 ..... 418/55.2
JP 05231352 A * 9/1993 ..... 418/55.2
JP A-2002-364563 12/2002

* cited by examiner

*Primary Examiner*—Theresa Trieu
(74) *Attorney, Agent, or Firm*—Posz Law Group, PLC

(57) ABSTRACT

A fluid machine includes a stationary scroll member and a movable scroll member. A second tooth portion of the movable scroll member is arranged to be revolved with respect to a first tooth portion of the stationary scroll member and to form an operating chamber between the movable scroll member and the stationary scroll member. The operating chamber is changeable in accordance with a revolution of the movable scroll member to be defined between two sliding contact portions, and is dividable into first and second operating chambers. The second tooth portion is provided with a passage portion through which an introducing port for introducing a fluid to the operating chamber communicates with the second operating chamber when the introducing port communicates with the first operating chamber. The passage portion disconnects the introducing port from the second operating chamber when the introducing port is disconnected from the first operating chamber.

17 Claims, 11 Drawing Sheets

SCROLL-TYPE FLUID MACHINE INCLUDING PASSAGE FORMED IN MOVABLE SCROLL

CROSS REFERENCE TO RELATED APPLICATION

This application is based on Japanese Patent Application No. 2005-61430 filed on Mar. 4, 2005, the contents of which are incorporated herein by reference in its entirety.

FIELD OF THE INVENTION

The present invention relates to a scroll-type fluid machine, which performs an expansion operation such that a fluid pressure in an expansion state is converted to a kinetic energy.

DESCRIPTION OF RELATED ART

Conventionally, a scroll-type expansion machine was disclosed in Japanese Unexamined Patent Publication No. 2002-364563. The expansion machine has an introducing port at a generally center of a base portion of a stationary scroll to introduce fluid and has an operation chamber, which is formed between a spiral tooth portion of the stationary scroll and a spiral tooth portion of a movable scroll. The expansion machine expands the introduced fluid, which is introduced through the introducing port, in the operation chamber.

Then, expansion start timing and expansion end timing of fluid in each of two operating chambers are not synchronized such that a variation in torque of rotational outputs by the expansion operation is reduced. Here, the two operating chambers are formed by dividing the operating chamber formed at a center portion of the expansion machine into two.

However, because the expansion machine is structured in such a manner that the expansion start timing and the expansion end timing of the fluid in each of two operating chambers are shifted, it is disadvantageously difficult for the shifted expansion machine to output the same amount as a normal expansion machine, which is not so structured, when the a size of the shifted expansion machine coincides with that of the normal expansion machine. In other words, the size of the shifted expansion machine becomes larger when the shifted expansion machine is required to output the same amount as the normal structured expansion machine.

In contrast, even when the expansion machine is so structured that the expansion start timing and the expansion end timing of the fluid in each of two operating chambers are synchronized, the expansion start timings of the fluid in the two operating chambers may be shifted by use of an enlarged introducing port, which is enlarged to reduce a flow resistance at the introducing port.

For example, a single operating chamber V is divided into two chambers (a first operating chamber V1 and a second operating chamber V2) when an end portion of a tooth portion 102*b* of a stationary scroll 102 contacts an end portion a tooth portion 103*b* of a movable scroll 103 at a contact portion as shown in FIG. 14. When an introducing port 105*a* is located off the contact portion of both the end portions, expansion start timing of fluid in the first operating chamber V1 is not synchronized with expansion start timing of fluid in the second operating chamber V2.

As a result, at the expansion end timing, an ultimate pressure in the first operating chamber V1 becomes different from that in the second operating chamber V2. For instance, this may disadvantageously cause over expansion in the second operating chamber V2 due to an earliness of the expansion start timing, in the case of an optimum expansion, where an ultimate pressure in the first operating chamber V1 is equal to a minimum pressure. Also, this may also disadvantageously cause under expansion in the first operating chamber V1 due to a delay of the expansion start timing, in the case of another optimum expansion, where an ultimate pressure in the second operating chamber V2 is equal to a minimum pressure. In the case of the over expansion or the under expansion, an efficiency of the expansion machine may not be maximized and may be deteriorated.

SUMMARY OF THE INVENTION

It is therefore an object of the present invention to provide a fluid machine for effectively performing expansion operation, which obviates or mitigates at least one of the above disadvantages.

To achieve the objective of the present invention, there is provided a fluid machine, which includes a stationary scroll member and a movable scroll member. The stationary scroll member includes a first base portion and a first tooth portion extending from the first base portion in an extending direction to have a spiral shape. The movable scroll member includes a second base portion and a second tooth portion extending from the second base portion in a direction opposite to the extending direction of the first tooth portion to have a spiral shape. The second tooth portion of the movable scroll member is arranged to be revolved with respect to the first tooth portion of the stationary scroll member and to form an operating chamber between the movable scroll member and the stationary scroll member. In this condition the operating chamber is changeable in accordance with a revolution of the movable scroll member to be defined between two sliding contact portions between the first and second tooth portions, and is dividable into a first operating chamber and a second operating chamber when a spiral end portion of the first tooth portion contacts a spiral end portion of the second tooth portion approximately at a center portion of the movable scroll member. Also, the stationary scroll member has an introducing port for introducing a fluid to the operating chamber at a center portion of the stationary scroll member. The second tooth portion is provided with a passage portion through which the introducing port communicates with the second operating chamber when the introducing port communicates with the first operating chamber. The passage portion disconnects the introducing port from the second operating chamber when the introducing port is disconnected from the first operating chamber.

Accordingly, it is possible to set expansion start timings of both the first and second operating chambers approximately at the same time, thereby effectively performing expansion operation.

For example, the passage portion can be provided such that a flow resistance of the fluid between the introducing port and the first operating chamber is approximately equal to that between the introducing port and the second operating chamber when the introducing port communicates with the first operating chamber.

The passage portion can be provided at the second tooth portion to extend in the extending direction of the second tooth portion. In this case, the passage portion can be located off a tip end portion of the second tooth portion in the extending direction of the second tooth portion. Alternatively, the passage portion can be located at a tip end portion of the second tooth portion in the extending direction of the second tooth portion.

The movable scroll member can be revolved relative to the stationary scroll member in a first rotation direction to perform an expansion-mode operation in which the operating chamber is divided into the first and second operating chambers, which are expanded radially outwardly. Furthermore, the movable scroll member can be revolved relative to the stationary scroll member in a second rotation direction opposite to the first rotation direction to perform a compression-mode operation, in which divided first and second operating chambers are displaced radially toward the center portion of the stationary scroll member to compress the fluid.

According to another aspect of the present invention, the second tooth portion has a spiral inner surface, and the passage portion is a recess recessed from the spiral inner surface. Therefore, the passage portion can be easily formed. The passage portion can be provided at the spiral end portion of the second tooth portion. Furthermore, a section of the passage portion perpendicular to the extending direction of the tooth portion can be formed into an arc shape.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

An embodiment of the present invention will be described with reference to accompanying drawings.

Figure 1:
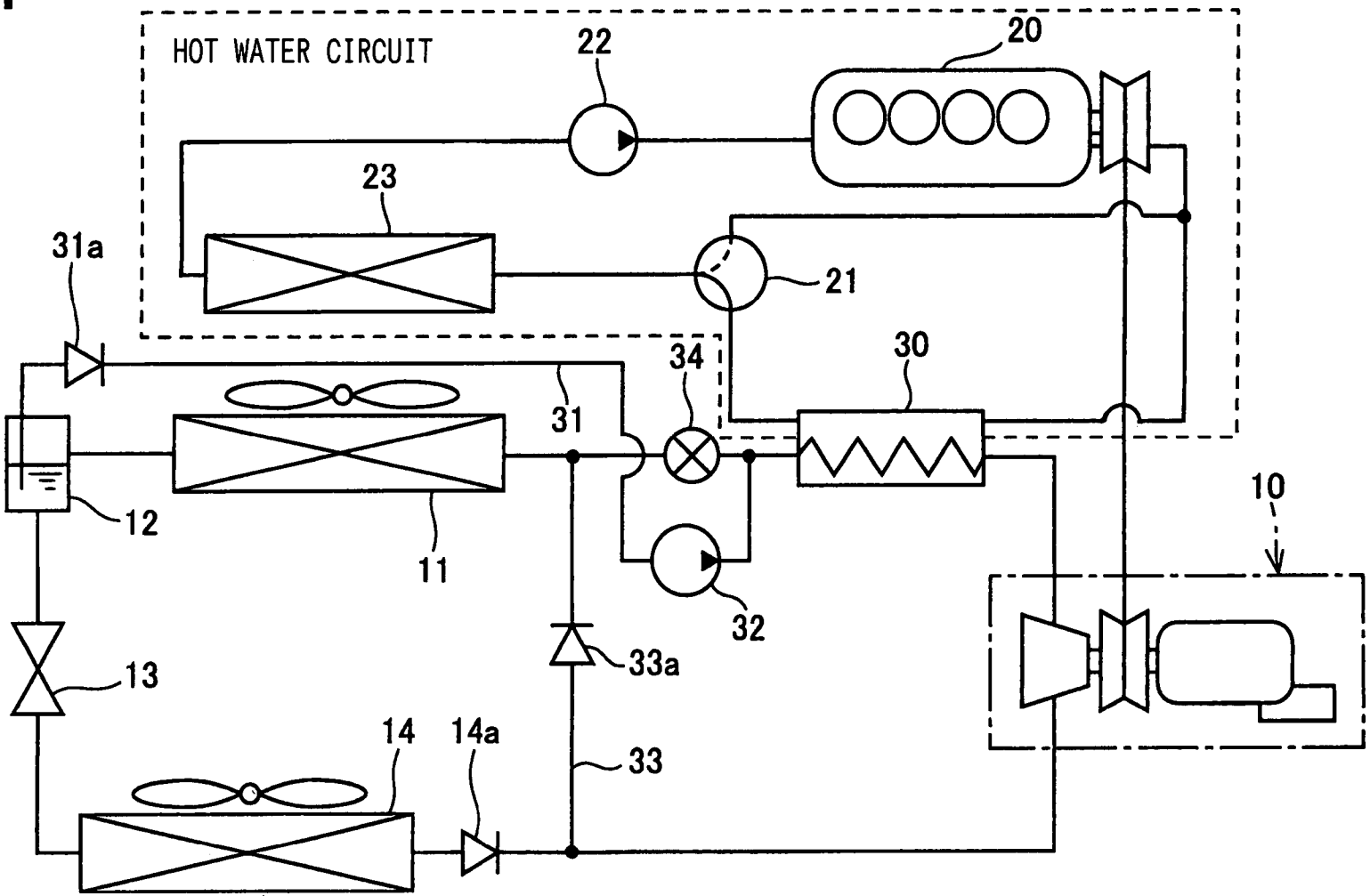
FIG. 1 is a schematic diagram showing a vapor-compression type refrigerating system with a Rankine cycle in an embodiment of the present invention.

In the present embodiment, a fluid machine of the present invention is typically used for a vapor-compression type refrigerating system with a Rankine cycle for a vehicle. FIG. 1 is a schematic view of the vapor-compression type refrigerating system in the present embodiment.

The vapor-compression type refrigerating system with the Rankine cycle of the present embodiment recovers a waste heat generated by an engine 20, which is a heat engine to generate a drive power. Also, vapor-compression type refrigerating system utilizes a low temperature heat and a high temperature heat, both of which are generated by the vapor-compression type refrigerating system, for performing air conditioning. The vapor-compression type refrigerating system with the Rankine cycle will be described.

The vapor-compression type refrigerating system includes an expander-integrated compressor 10, a refrigerant radiator 11, a gas-liquid separator 12, a decompressor 13 and an evaporator 14, which are connected to form a refrigerant circuit.

The expander-integrated compressor 10 is a fluid machine, which can operate in a pump-mode operation (compression-mode operation) and a motor-mode operation (expansion-mode operation). In the pump-mode operation, the expander-integrated compressor 10 compresses a gaseous refrigerant and discharges the compressed gaseous refrigerant. In the motor-mode operation, the expander-integrated compressor 10 converts a fluid pressure at the time of expansion of a superheated vapor refrigerant into a kinetic energy and outputs the kinetic energy. The refrigerant radiator 11 is connected with the expander-integrated compressor 10 on a discharging side thereof and is a cooling apparatus for cooling the refrigerant by heat radiation. In other words, the refrigerant radiator 11 is connected with a high-pressure port 110 of the expander-integrated compressor 10. The high-pressure port 110 will be described later. Details of the expander-integrated compressor 10 will be also descried later.

The gas-liquid separator 12 is a receiver, which receives the refrigerant from the refrigerant radiator 11, and which separates the gaseous refrigerant from liquefied refrigerant. The decompressor 13 decompresses and expands the liquefied refrigerant, which is separated from the gaseous refrigerant by the gas-liquid separator 12. In the present embodiment, the refrigerant is decompressed based on an enthalpy change and a thermal expansion valve, which controls an opening degree of a throttle opening, is used such that a degree of superheat of the refrigerant supplied to the expander-integrated compressor 10 becomes a predetermined value when the expander-integrated compressor 10 operates in the pump-mode operation.

The evaporator 14 is a heat absorber for evaporating the decompressed refrigerant, which is decompressed by the decompressor 13, so as to cause a heat absorbing action. That is, a low-pressure refrigerant decompressed in the decompressor is evaporated in the evaporator 14 by absorbing heat.

A heater 30 is a heat exchanger for heating the refrigerant by exchanging heat between engine coolant (hot water) and the refrigerant, which flows through a refrigerant circuit that connects the expander-integrated compressor 10 with the refrigerant radiator 11. Also, the heater 30 is located on the refrigerant circuit. A three-way valve 21 changes an operational state between first and second circulation modes. In the first circulation mode, the engine coolant, which is discharged from the engine 20, passes through the heater 30. In the second circulation mode, the coolant from the engine 20 bypasses the heater 30. The three-way valve 21 is controlled by an electronic control unit, which is not illustrated.

A first bypass circuit 31 is a refrigerant passage for introducing the liquefied refrigerant, which is separated by the gas-liquid separator 12, to a passage between the heater 30 and a refrigerant entrance side of the refrigerant radiator 11. The first bypass circuit 31 includes a fluid pump 32, which circulates the liquefied refrigerant, and includes a check valve 31*a*, which allows the refrigerant to flow only in a direction from the gas-liquid separator 12 to the heater 30. In the present embodiment, for example, the fluid pump 32 is an electrically powered pump and is controlled by an electronic control unit, which is not illustrated.

A second bypass circuit 33 is another refrigerant passage, which is connected to the refrigerant entrance side of the refrigerant radiator 11 and to a side of a low-pressure port 111 of the expander-integrated compressor 10 in the motor-mode operation. The low-pressure port 111 serves as a refrigerant discharging port, and at the time of the motor-mode operation of the expander-integrated compressor 10, the refrigerant is discharged from the low-pressure port 111 of the expander-integrated compressor 10. A check valve 33*a*, which allows the refrigerant to flow only in a direction from the expander-integrated compressor 10 to the refrigerant radiator 11 in the motor-mode operation, is provided on the second bypass circuit 33.

It is noted that a check valve 14*a* allows the refrigerant to flow only in a direction from a refrigerant outlet side of the evaporator 14 to the low-pressure port 111 of the expander-integrated compressor 10 in the pump-mode operation. The low-pressure port 111 also serves as an entrance port at the time of the pump-mode operation of the expander-integrated compressor 10. Also, an on-off valve 34 is an electromagnetic valve for opening and closing the refrigerant passage and is controlled by an electronic control unit, which is not illustrated.

A water pump 22 circulates the engine coolant, and a radiator 23 is a heat exchanger for exchanging heat between the engine coolant and outside air to cool the engine coolant. The water pump 22 is a mechanical pump, which is powered by the engine 20. However, the water pump 22 may be alternatively an electric pump, which is powered by an electric motor. There are a bypass circuit, which allows the coolant to bypass the radiator 23, and a flow regulating valve, which regulates amounts of coolant for the bypass circuit and the radiator 23, however, these are not illustrated in FIG. 1.

Next, the expander-integrated compressor 10 will be described in details.

Figure 2:
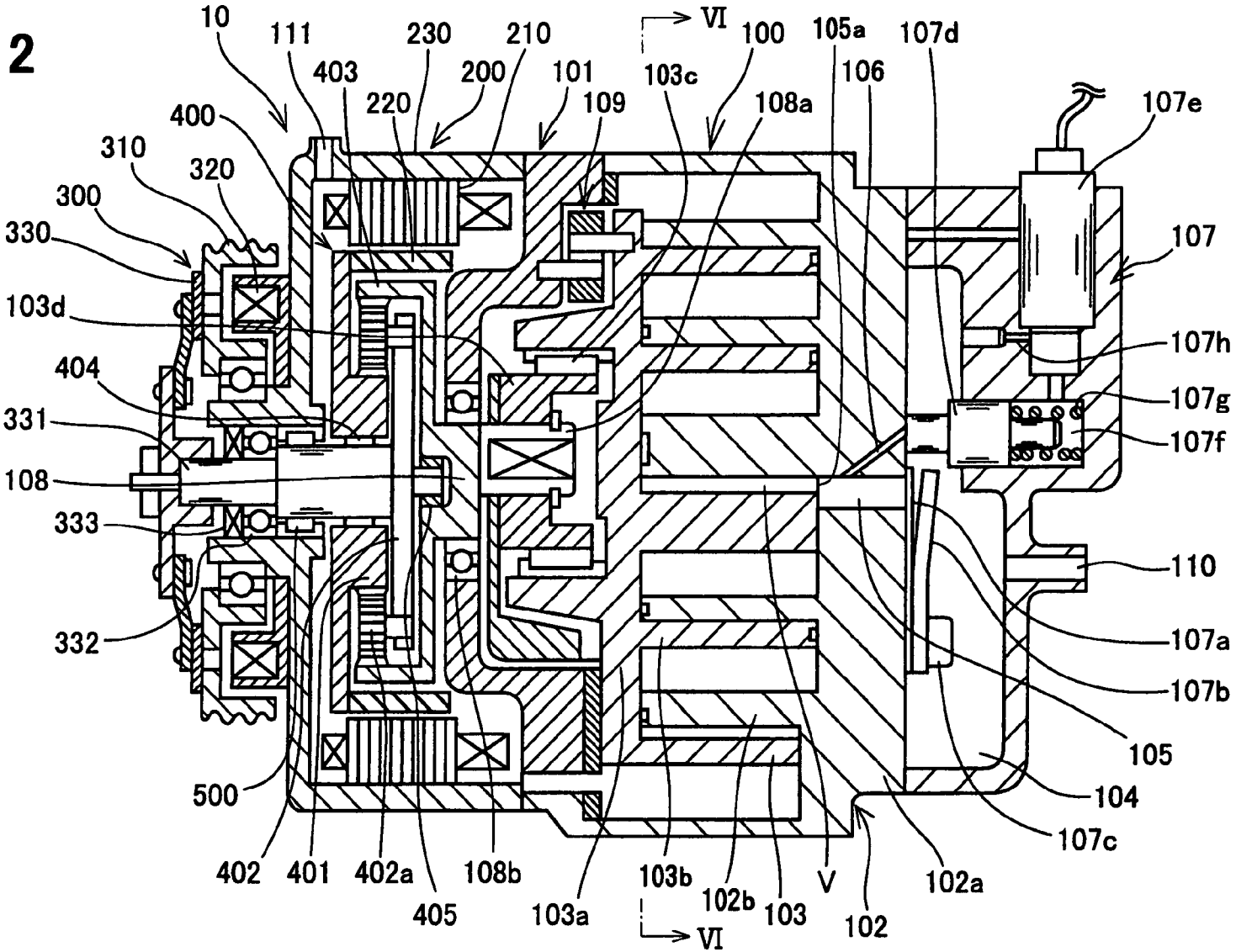
FIG. 2 is a sectional view showing an expander-integrated compressor in the embodiment.

FIG. 2 is a sectional view of the expander-integrated compressor 10, which includes a pump motor mechanism 100, a rotation electrical device 200, an electromagnetic clutch 300 and a speed changing mechanism 400. The pump motor mechanism 100 compresses or expands fluid (e.g., gaseous refrigerant in the present embodiment). The rotation electrical device 200 receives rotation energy to output electric energy and also the rotation electrical device 200 receives the electric energy to output the rotation energy. The electromagnetic clutch 300 serves as a power transmission mechanism and intermittently transmits power from the engine 20, which serves as an external drive source, to the pump motor mechanism 100. The speed changing mechanism 400 changes a power transmission connection between the pump motor mechanism 100, the rotation electrical device 200 and the electromagnetic clutch 300. Also, the speed changing mechanism 400 includes a planetary gear mechanism, which increases or decreases a rotation speed of the rotational power, and which transmits the rotation power.

Here, the rotation electrical device 200 includes a stator 210 and a rotor, which is rotated inside the stator 210. The stator 210 is a wire-wound stator coil. A rotor 220 is a magnet rotor, which includes a permanent magnet.

In the present embodiment, the rotation electrical device 200 serves as an electrical motor, which rotates the rotor 220 to drive the pump motor mechanism 100 when the stator 210 is supplied with the electric power. Also, the rotation electrical device 200 serves as a power generator, which corresponds to a regeneration mechanism in the present invention, for generating the electric power when the rotation electrical device 200 is supplied with torque through the rotor 220.

Also, the electromagnetic clutch 300 includes a pulley portion 310, an exciting coil 320 and a friction plate 330. Energization of the exciting coil 320 provides connection between the engine 20 and the expander-integrated compressor 10 as follows. The pulley portion 310 receives the power from the engine 20 through a V belt. The exciting coil 320 generates a magnetic field. The friction plate 330 is displaced based on an electromagnetic force, which is generated by the exciting coil 320. When energization of the exciting coil 320 is stopped, the engine 20 is disengaged from the expander-integrated compressor 10.

The pump motor mechanism 100 has a closely similar structure of well-known scroll compressor mechanism. Specifically, the pump motor mechanism 100 includes a stationary scroll (a stationary scroll member and a housing) 102, a revolving scroll (a movable scroll member) 103 and a valve mechanism 107 as shown in FIG. 2. The stationary scroll 102 is fixed to a stator housing 230 through a middle housing 101. The revolving scroll 103 serves as a movable member, which is displaced to revolve in a space defined by the middle housing 101 and the stationary scroll 102. The valve mechanism 107 opens and closes communication passage 105, 106, which provide communication between an operating chamber V and a high-pressure chamber 104.

Here, the stationary scroll 102 includes a base portion (a first base portion) 102*a* and a tooth portion (a first tooth portion) 102*b*. The base portion 102*a* is formed into a plate, and the tooth portion 102*b* is formed into a spiral shape, which projects from the base portion 102*a* toward the revolving scroll 103. In contrast, the revolving scroll 103 includes a base portion (a second base portion) 103*a* and a tooth portion (a second tooth portion) 103*b*. The tooth portion 103*b* contacts the tooth portion 102*b* and is meshed with the tooth portion 102*b*, and the tooth portion 103*b* is formed on the base portion 103*a*. In this structure, because the revolving scroll 103 revolves in such a manner that both the tooth portions 102*b*, 103*b* contact with each other, a volume of the operating chamber V defined by both the scrolls 102, 103 is increased or decreased.

A shaft 108 is a crankshaft, which includes an eccentrical portion 108*a* on one longitudinal end of the crankshaft. Here, the eccentrical portion 108*a* is eccentrically provided in relation to a rotation center axis of the shaft 108, and is connected with the revolving scroll 103 through a bushing 103*d* and a bearing 103*c*.

The bushing 103*d* is slightly displaceable in relation to the eccentrical portion 108*a*. In other words, the bushing 103*d* includes a driven-crank mechanism that displaces the revolving scroll 103 so that a contact pressure between both the tooth portions 102*b*, 103*b* is increased because of a compressive reaction force applied to the revolving scroll 103.

Also, a rotation prevention mechanism 109 allows the revolving scroll 103 to revolve around the eccentrical portion 108*a* by one revolution while the shaft 108 rotates one revolution. As a result, when the shaft 108 rotates one revolution, the revolving scroll 103 revolves around the rotation center axis of the shaft 108. At this time, the volume of the operating chamber V becomes decreased, when the operating chamber V is displaced from a radially outside portion of the revolving scroll 103 to a radially inside portion thereof. In the present embodiment, a pin-ring (pin-hole) type mechanism is used for the rotation prevention mechanism 109.

In the pump-mode operation, the communication passage 105 serves as a discharging port for providing communication between the operating chamber V and the high-pressure chamber 104 when the operating chamber V is minimized, such that the compressed refrigerant is discharged. In the motor-mode operation, the communication passage 106 serves as an inlet port for providing communication between the operating chamber V and the high-pressure chamber 104 when the operating chamber V is minimized, such that the high-pressure refrigerant (i.e., superheated vapor) is introduced to the operating chamber V.

The communication passage 106 is formed to be connected with the communication passage 105, and the opening portion of the communication passage 105 on the operating chamber V side thereof serves as an introducing port 105*a*, through which the refrigerant is introduced to the operating chamber V in the motor-mode operation. In contrast, in the pump-mode operation, the introducing port 105*a* serves as a discharging port, through which the refrigerant is discharged from the operating chamber V.

The high-pressure chamber 104 serves as a discharging chamber for smoothing a fluctuation of a flow of the refrigerant, which is discharged from the communication passage 105 (hereinafter described as a discharging port portion 105). The high-pressure chamber 104 includes the high-pressure port 110, which is connected to the heater 30 and the refrigerant radiator 11.

Here, the low-pressure port 111, which is connected to the evaporator 14 and also to the second bypass circuit 33, is provided in the stator housing 230. The low-pressure port 111 is communicated with a space defined by the stator housing 230 and the stationary scroll 102 through a space inside the stator housing 230.

Also, a discharging valve 107*a* is a reed-valve-shaped check valve, which is provided at the discharging port portion 105 on a high-pressure chamber 104 side thereof such that the refrigerant discharged through the discharging port portion 105 is prevented from flowing from the high-pressure chamber 104 back to the operating chamber V. A stopper 107*b* is a valve stopping plate for regulating a maximum opening degree of the discharging valve 107*a*. Both the discharging valve 107*a* and the stopper 107*b* are fixed to the base portion 102*a* by use of a bolt 107*c*.

A spool 107*d* is a valve body for opening and closing the communication passage 106 (hereinafter described as an inlet port 106). An electromagnetic valve 107*e* is a control valve for controlling pressure in a back pressure chamber 107*f* by controlling a communication state between the low-pressure port 111 and the back pressure chamber 107*f*. A spring 107*g* is a resilient means for applying a resilient force to the spool 107*d* in a direction such that the spool 107*d* is displaced to seal the inlet port 106. A throttle 107*h* provides communication between the back pressure chamber 107*f* and the high-pressure chamber 104 and is also a resistance means for providing a predetermined passage resistance to the communication between the back pressure chamber 107*f* and the high-pressure chamber 104.

When the electromagnetic valve 107*e* is opened, a pressure in the back pressure chamber 107*f* becomes lower than a pressure in the high-pressure chamber 104 so that the spool 107*d* pushes the spring 107*g* and is displaced in a right direction in FIG. 2. As a result, the inlet port 106 is opened. Because pressure loss through the throttle 107*h* is very large, only a negligibly small amount of the refrigerant flows into the back pressure chamber 107*f* from the high-pressure chamber 104.

In contrast, when the electromagnetic valve 107*e* is closed, the pressure in the back pressure chamber 107*f* becomes equal to the pressure in the high-pressure chamber 104. As a result, the spool 107*d* is displaced in a left direction in FIG. 2 by the resilience force of the spring 107*g* so that the inlet port 106 is sealed. This means that the spool 107*d*, the electromagnetic valve 107*e*, the back pressure chamber 107*f*, the spring 107*g* and the throttle 107*h* constitute a pilot operated electric on-off valve for opening and closing the inlet port 106.

Also, the speed changing mechanism 400 includes a sun gear 401, a planetary carrier 402 and a ring gear 403. The sun gear 401 is provided at a center portion of the speed changing mechanism 400. The planetary carrier 402 is connected with a pinion gear 402*a*, which rotates and revolves at an outer periphery of the sun gear 401. The ring gear 403 is provided at an outer periphery of the pinion gear 402*a*.

The sun gear 401 is integrated with the rotor 220 of the rotation electrical device 200, and the planetary carrier 402 is integrated with a shaft 331, which is rotated integrally with the friction plate 330 of the electromagnetic clutch 300.

A longitudinal end portion of the shaft 108 is integrated with an opposite side of the ring gear 403, which is opposite from the eccentric portion 108*a*.

Also, a one-way clutch 500 allows the shaft 331 to rotate in a one-way direction, which is a rotation direction of the pulley portion 310. A bearing 332 rotatably supports the shaft 331, and a bearing 404 rotatably supports the sun gear 401 (i.e., the rotor 220) with respect to the shaft 331. A bearing 405 rotatably supports the shaft 331 (i.e., the planetary carrier 402) with respect to the shaft 108. A bearing 108*b* rotatably supports the shaft 108 with respect to the middle housing 101.

A lip seal 333 is a shaft seal device for preventing the refrigerant from leaking through a gap between the shaft 331 and the stator housing 230 to an outside of the stator housing 230.

Here, the introducing port 105*a*, which introduces the refrigerant to the operating chamber V in the motor-mode operation, and a peripheral structure of the introducing port 105*a* will be described.

Figure 3:
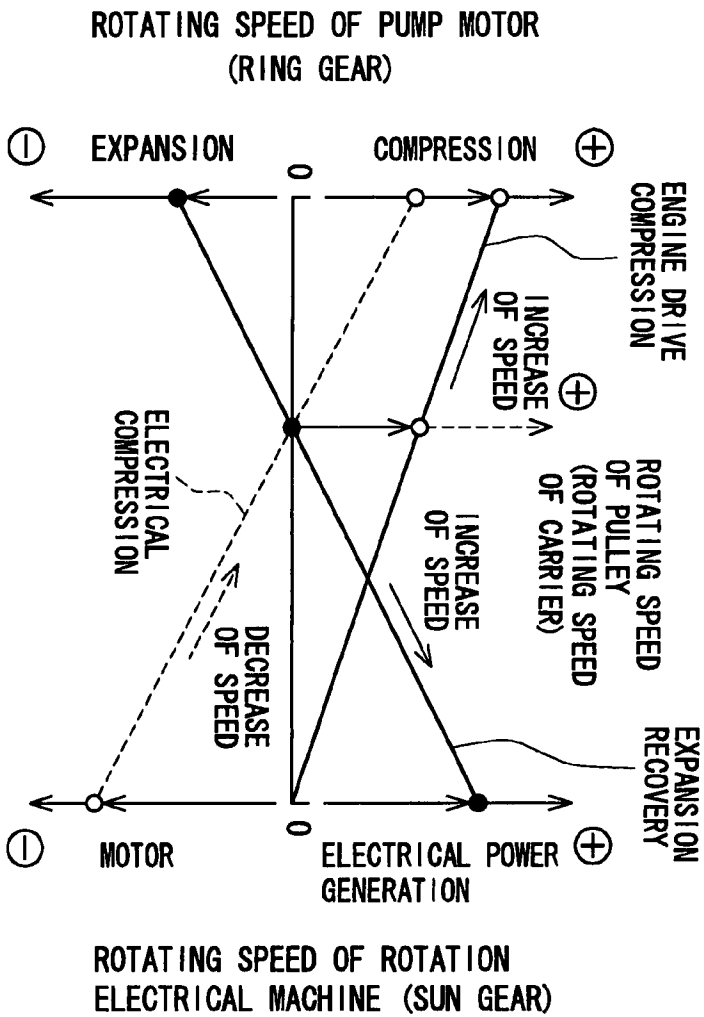
FIG. 3 is a monographic chart showing an operation of the expander-integrated compressor in the embodiment.

FIG. 3 is a monographic chart showing an operation of the expander-integrated compressor 10 in the present embodiment. The expander-integrated compressor 10 is operated in the compression-mode operation and the expansion-mode operation as shown in FIG. 3.

Figure 4:
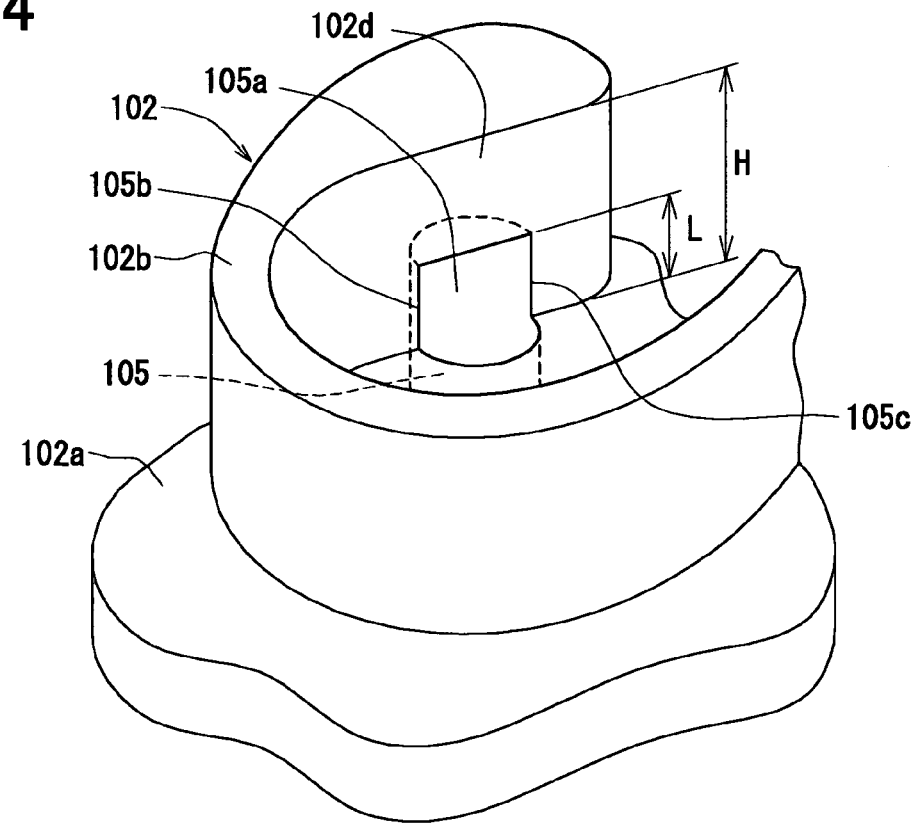
FIG. 4 is a perspective view of a spiral end portion on a center side of a tooth portion of a stationary scroll in the embodiment.

FIG. 4 is a perspective view showing a spiral end portion of the tooth portion 102*b* of the stationary scroll 102 (an end portion of the spiral on a center side of the stationary scroll 102, in other words, a winding starting portion).

As shown in FIG. 4, the discharging port portion 105 is formed to extend through the base portion 102*a* at a center portion of the stationary scroll 102, and is formed inside the tooth portion 102*b* such that the discharging port portion 105 extends inside the tooth portion 102*b*. The above-descried introducing port 105*a*, which is an opening end of the discharging port portion 105, opens around the connection between the base portion 102*a* and the tooth portion 102*b*. Also, the introducing port 105*a* extends in a tooth height direction (an extending direction of the tooth portion 102*b*) to open.

Also, an extending length L of the introducing port 105*a* in the tooth height direction of the tooth portion 102*b* is less than a height H of the tooth portion 102*b*. As a result, a tip end portion of the tooth portion 102*b* in the tooth extending direction serves as a barrier 102*d*, which is provided above the introducing port 105*a* as shown in FIG. 4. The barrier 102*d* blocks the refrigerant, which flows toward the introducing port 105*a* from the inlet port 106, such that the refrigerant is prevented from reaching the tip end portion of the tooth portion 102*b* in FIG. 4. That is, the barrier 102*d* prevents the refrigerant from flowing to the base portion 103*a* of the revolving scroll 103.

Figure 5:
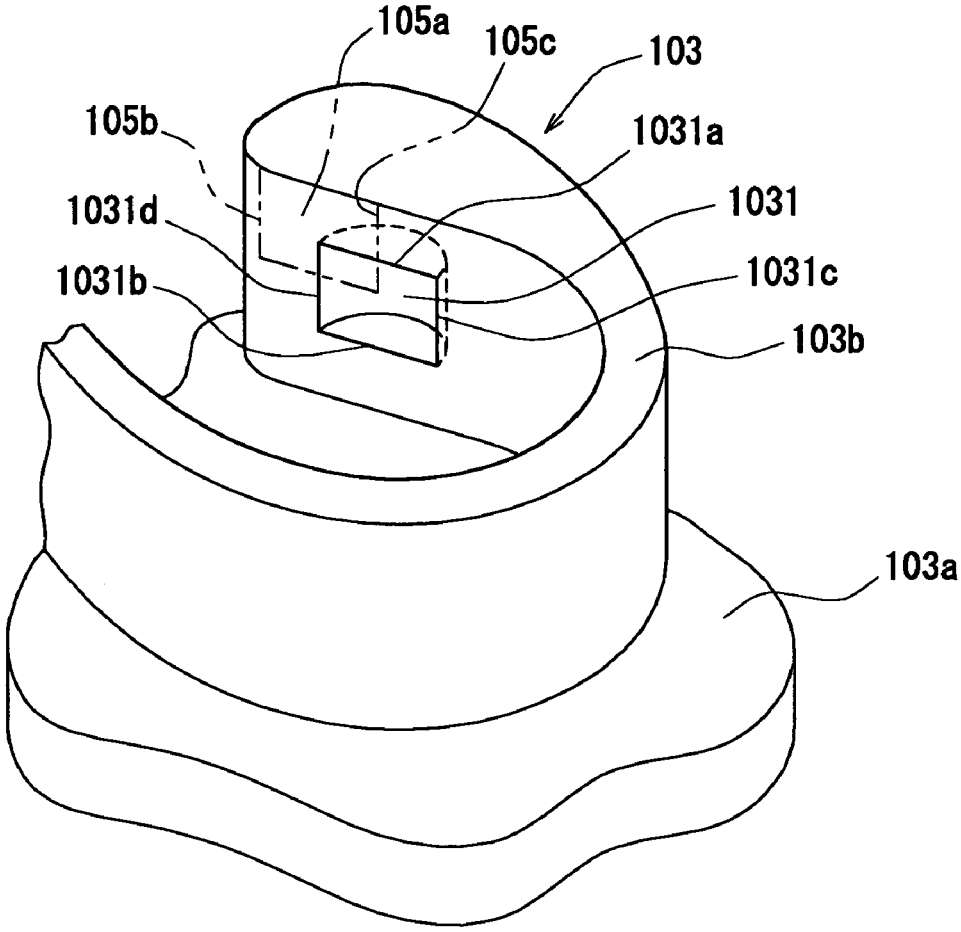
FIG. 5 is a perspective view of a spiral end portion on a center side of a tooth portion of a revolving scroll in the embodiment.

In contrast, FIG. 5 is a perspective view showing a spiral end portion of the tooth portion 103*b* of the revolving scroll 103 (an end portion of the spiral on a center side of the tooth portion 103*b*, in other words, a winding starting portion), which is meshed with the stationary scroll 102. In FIG. 5, for better understanding, the spiral end portion of the tooth portion 103*b* of the revolving scroll 103 is turned upside down from a posture, with which the revolving scroll 103 is meshed with the stationary scroll 102 shown in FIG. 4.

As shown in FIG. 5, a recess portion 1031 is formed on an inner surface of the spiral end portion of the tooth portion 103*b* of the revolving scroll 103. A section of the recess portion 1031, which extends in parallel to an extending direction of a spiral of the tooth portion 103*b*, is formed into an arc shape. That is, a section of the recess portion 1031, which is perpendicular to the tooth extending direction, is formed into an arc shape. The recess portion 1031 serves as a passage portion in the present embodiment.

The recess portion 1031 is formed at a position such that the recess portion 1031 faces the introducing port 105*a* of the stationary scroll 102 when the revolving scroll 103 is meshed with the stationary scroll 102.

In FIG. 5, a chain double-dashed line indicates a momentary position of the introducing port 105*a* at the time where the spiral end portion of the tooth portion 103*b* of the revolving scroll 103 contacts the spiral end portion of the tooth portion 102*b* of the stationary scroll 102 in the motor-mode operation. As shown in FIG. 5, the recess portion 1031 is formed to overlap with the introducing port 105*a* in the tooth extending direction. In other words, in FIG. 4, at least a part of the recess portion 1031 faces with an end opening part of the introducing port 105*a*.

An opening range of the recess portion 1031 in an extending direction of the spiral of the tooth portion 103*b* is determined such that the recess portion 1031 overlaps with the introducing port 105*a*. Therefore, such that the recess portion 1031 communicates with the introducing port 105*a*. In FIG. 5, the recess portion 1031 is formed to include a first margin 1031*a* and a second margin 1031*b* in the tooth extending direction such that at least a part of the first margin 1031*a* of the recess portion 1031, close to the tip end of the tooth portion 103*b*, is positioned within an opening of the introducing port 105*a*.

Also, the recess portion 1031 is formed at a position in the extending direction of the spiral of the tooth portion 103*b* such that the recess portion 1031 faces with the introducing port 105*a* of the stationary scroll 102 at the time where a volume of an operating chamber V, which is newly formed at a center portion of the scroll by the tooth portion 102*b* of the stationary scroll 102 and the tooth portion 103*b* of the revolving scroll 103, becomes minimum.

This means that a forward edge 1031*c* of the recess portion 1031 in the outwardly extending direction of the spiral of the tooth portion 103*b* (a spiral direction of the tooth portion 103*b*) is located to coincide with a backward edge 105*c* of the introducing port 105*a* when the volume of the newly formed operating chamber V becomes minimum in FIG. 5. Similarly, a backward edge 1031*d* of the recess portion 1031 is located to coincide with a forward edge 105*b* of the introducing port 105*a* when the volume of the newly formed operating chamber V becomes minimum in FIG. 5. In FIG. 5, the forward edge 1031*c* and the backward edge 1031*d* of the recess portion 1031 extend in the tooth height direction (the upright direction in FIG. 5) of the tooth portion 103*b*. In FIG. 4, the forward edge 105*b* and the backward edge 105*c* of the introducing port 105*a* extend in the tooth height direction of the tooth portion 102*b*.

The recess portion 1031 serves as an opening portion, which opens at a wall of the tooth portion 103*b* of the revolving scroll 103, and a passage portion, which is located behind the opening portion. The opening portion of the recess portion 1031 extends in a range, which overlaps with the introducing port 105*a*, with respect to the extending direction of the tooth portion 103*b*. Further, the opening portion of the recess portion 1031 is formed into a shape such that when the volume of the operating chamber V becomes approximately minimum, the shape of the opening portion coincides with the range and shape of the introducing port 105*a* with respect to the spiral direction of the tooth portion 103*b*.

The opening portion of the recess portion 1031 may be alternatively formed into a quadrangle, a parallelogram or an oblong, a forward edge and a backward edge of each of which coincide with those of the introducing port 105*a*. In the embodiment shown in FIG. 5, a rectangular opening portion is formed as the opening portion of the recess portion 1031 such that two edges 1031*c*, 1031*d* located in the spiral direction adjust a communication state with the introducing port 105*a*. Also, a location and a shape of each of the two edges 1031*c*, 1031*d* of the recess portion 1031 corresponds to a shape of the introducing port 105*a* such that the communication between the introducing port 105*a* and one of two operating chambers is disconnected simultaneously when the communication between the introducing port 105*a* and the other of two operating chambers is disconnected.

The passage portion of the recess portion 1031 is defined as a space with a closed end and only opens through the opening portion for communication. The passage portion of the recess portion 1031 may be formed into various shapes, such as an arc and trapezoid. Other various shapes may be determined, for example, based on a consideration of processability thereof.

A location of the recess portion 1031 in the spiral direction of the tooth portion 103*b* will be described in detail when an operation of the embodiment is discussed later.

Next, operations and effects of the expander-integrated compressor 10 in the present embodiment will be described.

Firstly, the pump-mode operation (compression-mode operation) will be described. In the pump-mode operation, the shaft 108 is rotated to revolve the revolving scroll 103 of the pump motor mechanism 100 such that the refrigerant is drawn and compressed.

Specifically, the on-off valve 34 is opened while the fluid pump 32 is stopped, and the three-way valve 21 is operated such that the engine coolant is not circulated through the heater 30. Also, under the condition, where the electromagnetic valve 107*e* is closed such that the spool 107*d* closes the inlet port 106, the shaft 108 is rotated in the pump-mode operation.

As a result, similarly to the well-known scroll type compressor, the expander-integrated compressor 10 draws the refrigerant through the low-pressure port 111 and compresses the refrigerant in the operating chamber V (or, a pair of chambers, a first operating chamber V1 and a second operating chamber V2), which is displaced toward the center portion of the scroll from radially outward portion thereof. Then, this compressed refrigerant is discharged from the combined operating chambers V1, V2 to the high-pressure chamber 104 through the discharging port portion 105, and the compressed refrigerant is discharged from the high-pressure port 110 to the refrigerant radiator 11.

FIGS. 6A to 6D are schematic diagrams of the expander-integrated compressor 10 taken along line VI-VI in FIG. 2. The revolving scroll 103 revolves one revolution as shown in the drawings in the order of FIG. 6D to FIG. 6A in the pump-mode operation (compression-mode operation).

At this time, there are first and second connection states for rotating the shaft 108. In the first connection state, mainly the electromagnetic clutch 300 connects the engine 20 with the expander-integrated compressor 10 such that the power of the engine is used to rotate the shaft 108. In the second connection state, the electromagnetic clutch 300 disconnects the engine 20 from the expander-integrated compressor 10 such that the rotation electrical device 200 rotates the shaft 108.

Then, in the first connection state, where the electromagnetic clutch 300 connects the engine 20 with the expander-integrated compressor 10 such that the power of the engine 20 is used to rotate the shaft 108, the electromagnetic clutch 300 is energized such that the electromagnetic clutch 300 provides connection, and at the same time the rotation electrical device 200 is energized to generate a torque by an intensity, which is so low that the sun gear 401 and the rotor 220 cannot be rotated.

Therefore, the torque of the engine 20, which is transmitted through the pulley portion 310, is increased in the speed changing mechanism 400, and the increased torque is transmitted to the pump motor mechanism 100. Then, the pump motor mechanism 100 is operated as a compressor. This operation corresponds to an engine drive compression in FIG. 3.

In contrast, in the second connection state, where the electromagnetic clutch 300 disconnects the engine 20 from the expander-integrated compressor 10 such that the rotation electrical device 200 rotates the shaft 108, the rotation electrical device 200 is energized while the energization of the electromagnetic clutch 300 is stopped for disengaging the electromagnetic clutch. Then, the rotation electrical device 200 is rotated in an opposite direction, which is opposite from the rotation direction of the pulley portion 310, such that the pump motor mechanism 100 is operated as the compressor.

At this time, the shaft 331 (the planetary carrier 402) is not rotated because of a lock by the one-way clutch 500. Thus, the torque of the rotation electrical device 200 is decreased by the speed changing mechanism 400 and is transmitted to the pump motor mechanism 100. This operation corresponds to an electrical compression in FIG. 3.

Then, the refrigerant, which is discharged through the high-pressure port 110, circulates a refrigeration cycle in the order of the heater 30→the on-off valve 34→the refrigerant radiator 11→the gas-liquid separator 12→the decompressor 13→the evaporator 14→the check valve 14*a*→the low-pressure port 111 of the expander-integrated compressor 10. In the refrigeration cycle, the evaporator 14 performs cooling by absorbing heat of air, and the refrigerant radiator 11 performs heating by radiating heat to the air. Here, because the engine coolant is not circulated through the heater 30, the refrigerant is not heated by the heater 30, and therefore the heater 30 merely serves as a refrigerant passage.

The motor-mode operation (expansion-mode operation) will be described. In the motor-mode operation, the high-pressure superheated vapor refrigerant, which is heated at the heater 30, is introduced to the pump motor mechanism 100 through the high-pressure chamber 104 and the superheated vapor refrigerant is expanded. As a result, the revolving scroll 103 is revolved to rotate the shaft 108 such that a mechanical output can be generated.

In the present embodiment, the rotor 220 is rotated by use of the generated mechanical output such that the rotation electrical device 200 generates the electric power, and the generated power is stored in a battery.

Specifically, the fluid pump 32 is operated while the on-off valve 34 is closed. Then, the three-way valve 21 is operated such that the engine coolant is circulated through the heater 30. Also, the energization of the electromagnetic clutch 300 of the expander-integrated compressor 10 is stopped to disengage the electromagnetic clutch 300. In this state, the electromagnetic valve 107*e* is opened such that the spool 107*d* opens the inlet port 106 and the high-pressure superheated vapor refrigerant, which is heated by the heater 30, is introduced to the high-pressure chamber 104, and then is introduced to the operating chamber V through the inlet port 106. Then, the superheated vapor refrigerant is expanded in the operational chamber V (specifically, a pair of separately defined chambers, the first operational chamber V1 and the second operational chamber V2), which is generated at the center portion of the scroll and is displaced radially outward.

In this case, by the expansion of the superheated vapor, the revolving scroll 103 is rotated in an opposite direction, which is opposite from the rotation direction of the revolving scroll 103 in the pump-mode operation. Therefore, the expanded refrigerant, the pressure of which is decreased after the expansion, is discharged to the refrigerant radiator 11 through the low-pressure port 111. Then, a rotation energy given to the revolving scroll 103 is increased by the speed changing mechanism 400 and is transmitted to the rotor 220 of the rotation electrical device 200.

At this time, the shaft 331 (the planetary carrier 402) is not rotated because of the lock by the one-way clutch 500. Thus, the torque of the rotation electrical device 200 is increased by the speed changing mechanism 400 and is transmitted to the pump motor mechanism 100. This operation corresponds to expansion recovery in FIG. 3.

Then, the refrigerant discharged through the low-pressure port 111 is circulated in the Rankine cycle in the order of the second bypass circuit 33→the check valve 33*a*→the refrigerant radiator 11→the gas-liquid separator 12→the first bypass circuit 31→the check valve 31*a*→the fluid pump 32→the heater 30→the high-pressure port 110 of the expander-integrated compressor 10. Here, the fluid pump 32 pumps and supplies the liquefied refrigerant into the heater 30 by a pressure, which is set such that super-heated gaseous refrigerant generated by being heated by the heater 30 will not flows back toward the gas-liquid separator 12.

Next, a formation of the operating chamber V at the scroll center portion in the motor-mode operation will be described. Also, the following state, where the operating chamber V is divided into the first operating chamber V1 and the second operating chamber V2, will be described.

FIGS. 6A to 6D are the schematic diagrams of the expander-integrated compressor 10 taken along line VI-VI in FIG. 2. The revolving scroll 103 revolves one revolution as shown in the drawings in the order of FIG. 6A to FIG. 6D.

Figure 6A:
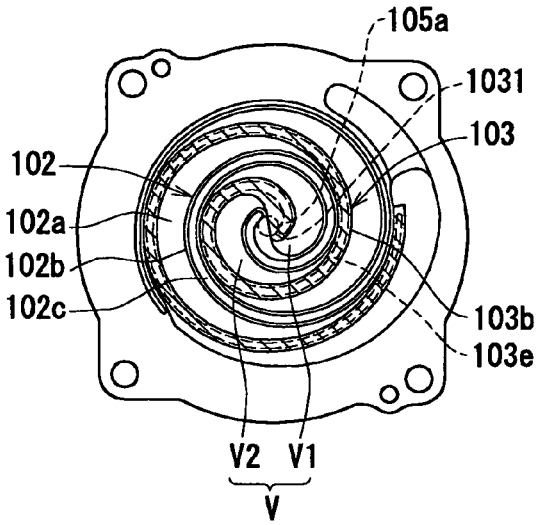
FIG. 6A is a sectional view taken along line VI-VI in FIG. 2 showing an operational state of the revolving scroll.

As shown in FIG. 6A, the tooth portion 102*b* of the stationary scroll 102 contacts the tooth portion 103*b* of the revolving scroll 103 at the scroll center portion.

Figure 6B:
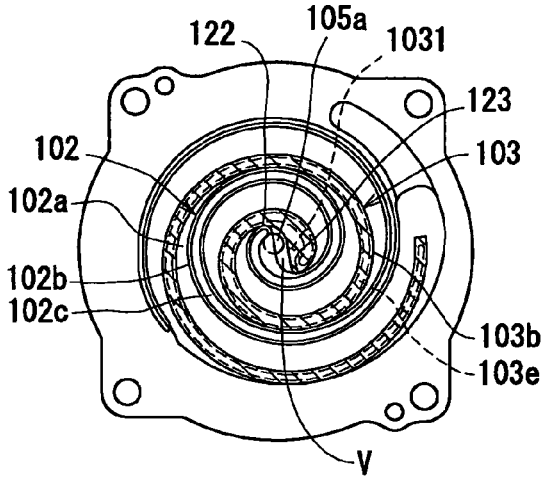
FIG. 6B is a sectional view taken along line VI-VI in FIG. 2 showing another operational state of the revolving scroll.

Next, the tooth portion 103*b* of the revolving scroll 103 is displaced as shown in FIG. 6B, and a contact portion between the tooth portions 102*b*, 103*b* is changed to two sliding contact portions 122, 123 such that an operating chamber V is defined between the two sliding contact portions 122, 123. Then, the high-pressure superheated refrigerant is introduced to the operating chamber V through the introducing port 105*a*.

Figure 6C:
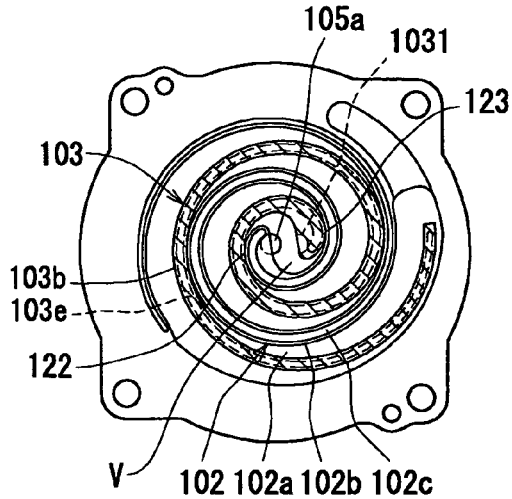
FIG. 6C is a sectional view taken along line VI-VI in FIG. 2 showing another operational state of the revolving scroll.
Figure 6D:
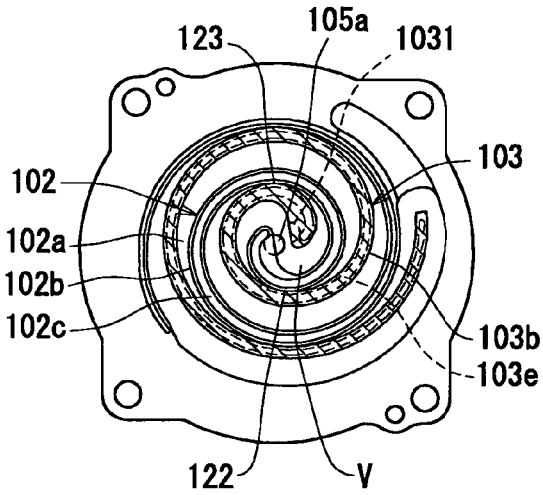
FIG. 6D is a sectional view taken along line VI-VI in FIG. 2 showing another operational state of the revolving scroll.

When the operating chamber V begins to be newly formed at the scroll center portion (when the operating chamber V at the scroll center portion is minimized), the refrigerant is introduced to the operating chamber V through the introducing port 105*a*. This introduction of the high-pressure refrigerant to the operating chamber V at the center portion is maintained while the operating chamber V is expanded due to displacement of the two sliding contact portions 122, 123 as shown in FIGS. 6C, 6D.

When the revolving scroll 103 revolves one revolution so that it is placed at the state shown in FIG. 6A, the introduction of the refrigerant to the operating chamber V formed at the scroll center portion is stopped. Then, the operating chamber V is divided into the first operating chamber V1 and the second operating chamber V2 such that the first and second operating chambers V1, V2 will be displaced to a radially outward portion of the scroll.

Immediately after the revolving scroll 103 is placed back to the state shown in FIG. 6A, a new operating chamber V is formed at the timing, where the contact portion is changed to the two sliding contact portions 122, 123, as described above. At this time, the divided operating chambers (the first and second operating chambers V1, V2), which are displaced to the radially outward portion of the scroll, are separated from and sealed from the newly formed operating chamber V by the two sliding contact portions 122, 123.

The introduction of the refrigerant to the first and second operating chambers V1, V2 and the stop of the introduction of the refrigerant thereto (i.e., expansion starting operation) will be described in details.

Figure 7A:
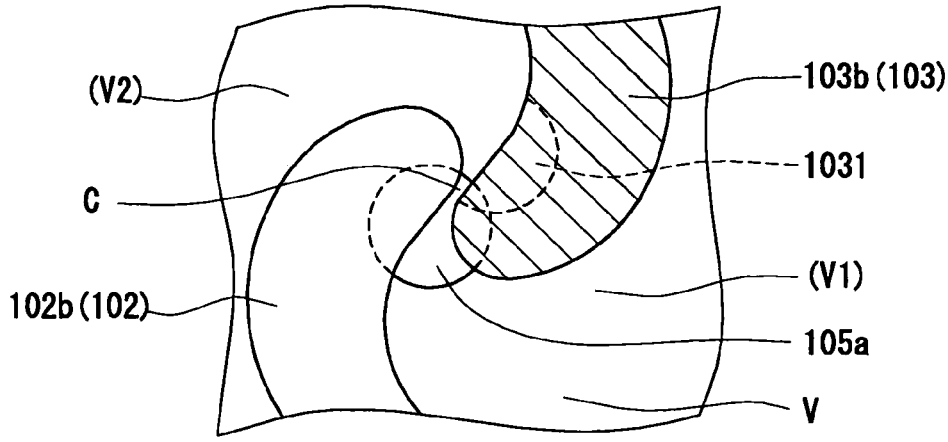
FIG. 7A is an enlarged sectional view of a center portion of scrolls, showing an operational state where an operating chamber approaches to be divided, and where refrigerant is introduced to the operating chamber.

The introduction of the refrigerant to the operating chamber V is continued during the rotation of the revolving scroll 103 until the spiral end portion of the tooth portion 103*b* is displaced to be adjacent to the spiral end portion of the tooth portion 102*b* of the stationary scroll 102 as shown in FIG. 7A.

At this time, because the introducing port 105*a* opens widely to a first region, which will develop to the first operating chamber V1 by the division of the operating chamber V, the refrigerant is directly introduced to the first region through the introducing port 105*a*.

In contrast, the introducing port 105*a* communicates with a second region, which will develop to the second operating chamber V2 by the division of the operating chamber V, through a gap portion C between the spiral end portions of the tooth portions 102*b*, 103*b*. At this time, the recess portion 1031 formed at the tooth portion 103*b* is already placed in a position such that a part of the recess portion 1031 close to the spiral end portion of the tooth portion 103*b* faces with the introducing port 105*a*.

Therefore, the refrigerant circulates through the narrow gap portion C and the recess portion 1031 when the refrigerant is introduced to the second region, which will develop to the second operating chamber V2, through the introducing port 105*a*. The recess portion 1031 is formed in such a manner that a flow resistance (pressure loss) of a refrigerant passage, which includes the gap portion C and the recess portion 1031, is similar to a flow resistance of a refrigerant passage, which connects the introducing port 105*a* with the first region for the introduction of the refrigerant. Here, the first region is a region, which will develop to the first operating chamber V1 when the operating chamber V is divided into two chambers.

As a result, even in a case where the spiral end portion of the tooth portion 103*b* of the revolving scroll 103 is positioned adjacent to the end portion of the tooth portion 102*b* of the stationary scroll 102 as shown in FIG. 7A, the refrigerant is generally evenly introduced to both the first and second regions in the operating chamber V.

Figure 7B:
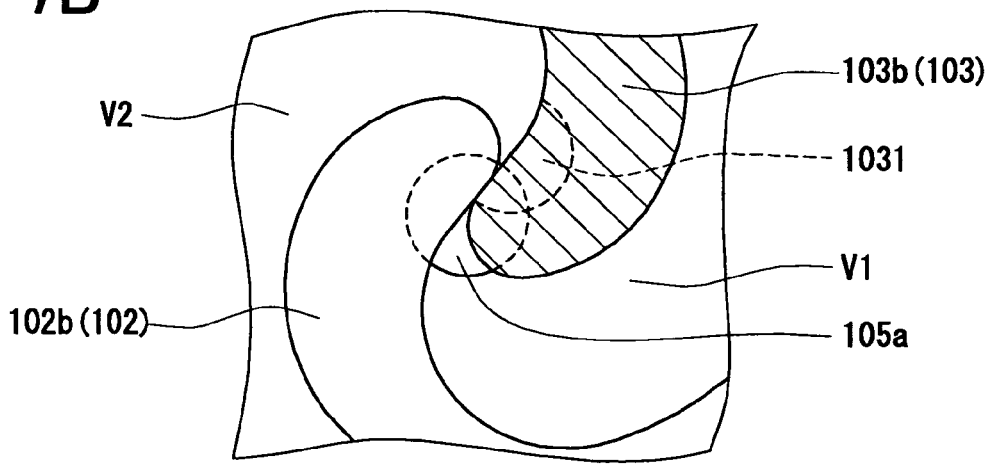
FIG. 7B is an enlarged sectional view of a center portion of scrolls, showing an operational state where the operating chamber is divided into two operating chambers, and where refrigerant is introduced to the two operating chambers.

When the revolving scroll 103 is further revolved, the spiral end portion of the tooth portion 103*b* contacts the spiral end portion of the tooth portion 102*b* of the stationary scroll 102 as shown in FIG. 7B such that the operating chamber V is divided into the first operating chamber V1 and the second operating chamber V2.

The introducing port 105*a* in the present embodiment is formed to be located closer to the first operating chamber V1 than to the contact portion between both the tooth portions 102*b*, 103*b*. Therefore, the introducing port 105*a* in a state shown in FIG. 7B opens to the first operating chamber V1 such that the refrigerant is continuously introduced to the first operating chamber V1 through the introducing port 105*a* while an opening area of the introducing port 105*a* is reduced to be less than that in a state shown in FIG. 7A.

In contrast, although the gap portion C disappears when the spiral end portions of the both tooth portions 102*b*, 103*b* contacted with each other in the state shown in FIG. 7B, the second operating chamber V2 communicates with the introducing port 105*a* through the recess portion 1031, a part of which faces with the introducing port 105*a*. At this time, a facing area of the recess portion 1031, which faces with the introducing port 105*a*, is increased to be larger than that in a state shown in FIG. 7A.

Therefore, the refrigerant, which is introduced to the second operating chamber V2 through the introducing port 105*a*, can circulate through the recess portion 1031. The recess portion 1031 is formed in such a manner that a flow resistance (pressure loss) of a refrigerant passage, which includes the recess portion 1031, is similar to a flow resistance of a refrigerant passage, through which the introducing port 105*a* communicates with the first operating chamber V1.

As a result, even in a case, where the spiral end portion of the tooth portion 103*b* of the revolving scroll 103 contacts the spiral end portion of the tooth portion 102*b* of the stationary scroll 102 as shown in FIG. 7B, the refrigerant is generally evenly introduced to both the first and second operating chambers V1, V2, which are separately defined.

Figure 7C:
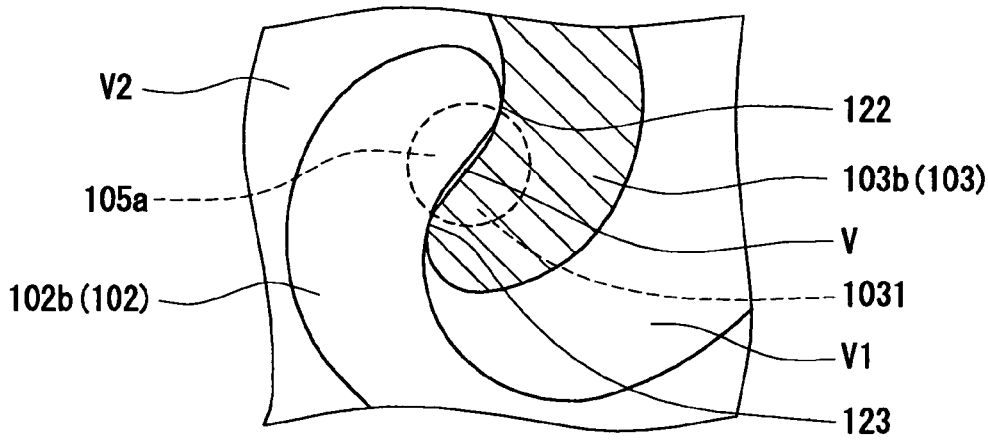
FIG. 7C is an enlarged sectional view of a center portion of scrolls, showing an operational state where an introduction of the refrigerant to the two operating chambers is ended.

When the revolving scroll 103 is further revolved, the contact portion between the tooth portions 102*b*, 103*b* is changed to the two sliding contact portions 122, 123 such that a new operating chamber V is defined between the two sliding contact portions 122, 123 as shown in FIG. 7C. In this case, the operating chamber V has a generally minimum volume.

When a new operating chamber V, a volume of which is generally minimum, is formed, the two sliding contact portions 122, 123 are positioned outwardly around the introducing port 105*a* and the recess portion 1031 such that the new operating chamber V is separated from the first and second operating chambers V1, V2 by the two sliding contact portions 122, 123 as shown in FIG. 7C.

Therefore, the new operating chamber V is formed in such a manner that the new operating chamber V is separated from the first and second operating chambers V1, V2, which are previously formed by the division. When the refrigerant begins to be introduced to the new operating chamber V through the introducing port 105*a* (when a new operating chamber V, which is formed at the center portion of the scroll, is minimum), the introduction of the refrigerant to the first and second operating chambers V1, V2 is stopped. Then, the refrigerant in the first and second operating chambers V1, V2 starts to be expanded outwardly.

In the above-described structures and operations, the recess portion 1031 is formed at the tooth portion 103*b* of the revolving scroll 103, and the recess portion 1031 provides communication between the second operating chamber V2 and the introducing port 105*a* when the introducing port 105*a* opens to the first operating chamber V1.

Also, when the introducing port 105*a* is disconnected from the first operating chamber V1, the recess portion 1031 is simultaneously disconnected from the second operating chamber V2.

Therefore, the first operating chamber V1 is disconnected from the introducing port 105*a* simultaneously when the second operating chamber V2 is disconnected from the introducing port 105*a*. This means that the expansion in the first operating chamber V1 starts simultaneously when the expansion in the second operating chamber V2 starts.

Likewise, a gap of the expansion start timing between the first operating chamber V1 and the second operating chamber V2 is corrected such that the expansion operation is effectively performed.

Also, the recess portion 1031 is formed in such a manner that the flow resistance (pressure loss) for the refrigerant between the introducing port 105*a* and the second operating chamber V2 is similar to the flow resistance (pressure loss) for the refrigerant between the introducing port 105*a* and the first operating chamber V1 when the introducing port 105*a* opens to the first operating chamber V1.

As a result, before the first and second operating chambers V1, V2 are started to be expanded, approximately the same amount of the refrigerant is introduced to regions, which will develop to the first operating chamber V1 and the second operating chamber V2 separated from each other. Therefore, the refrigerant in the first and second operating chambers V1, V2, is limited from the over expansion or the insufficient expansion such that the expansion operation can be performed more efficiently.

Also, the recess portion 1031 is formed at the tooth portion 103*b* of the revolving scroll 103 and is located off the tip end portion of the tooth portion 103*b* in the tooth extending direction. Therefore, strength of the tooth portion 103*b* can be easily achieved.

Also, the recess portion 1031 is formed into a shape such that a section of the recess portion 1031 perpendicular to the tooth extending direction is the arc shape. Therefore, the flow resistance (pressure loss) for the refrigerant is easily adjustable, and at the same time the recess portion 1031 is easy to be machined by a disc-type rotating cutter or a disc-type grinder when a side surface portion of the tooth portion 103*b* is machined.

Figure 8:
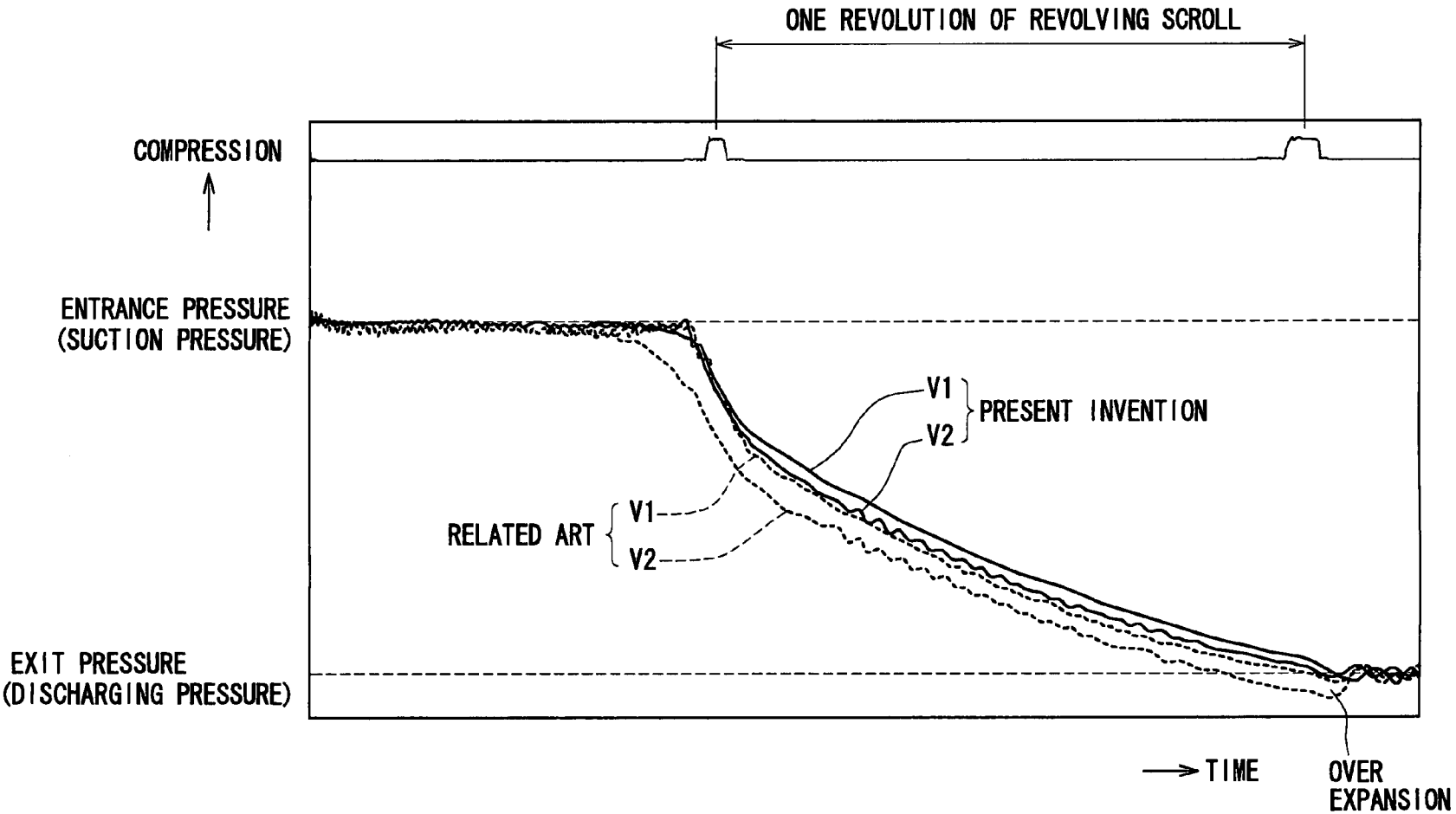
FIG. 8 is a graph showing variations of measured pressures in the operating chamber at the time of a motor-mode operation.
Figure 14:
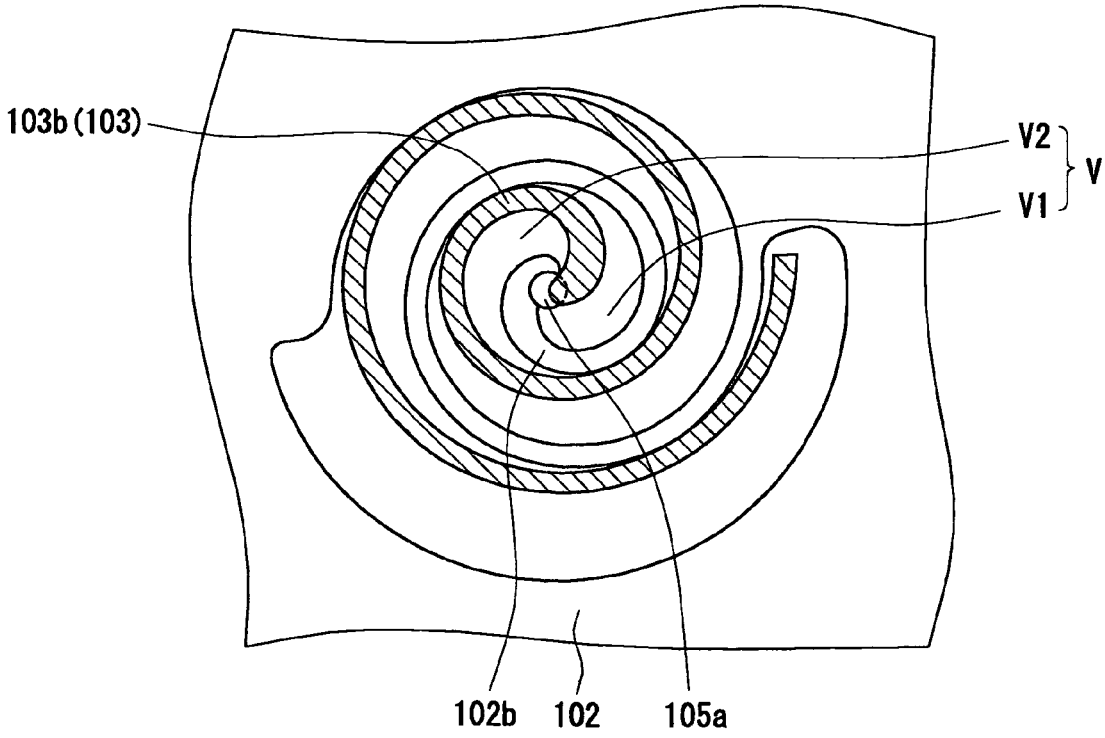
FIG. 14 RELATED ART
FIG. 14 is a sectional view showing an operational state of a revolving scroll in a related art.

FIG. 8 is a graph showing variations in measured pressures in the operating chamber of the expander of a comparison example shown in FIG. 14 and in the operating chamber of the integrated-expander compressor 10 of the present embodiment at the time of the motor-mode operation (expansion-mode operation). This measurement was conducted by the inventers of the present invention.

Expansion starting timing between the operating chambers V1, V2 of the expander in the related art shown in FIG. 14 are different from each other as shown in FIG. 8. That is, the expansion of the refrigerant in the second operating chamber V2 starts earlier than that in the first operating chamber V1 does. Therefore, the over expansion is generated in the second chamber V2 when the expansion is completed.

In contrast, in the expander-integrated compressor 10 of this embodiment, the expansion starting timing of the first operating chamber V1 coincides with that of the second operating chamber V2. Therefore, approximately even expansion can be performed such that the over expansion or the under expansion does not generate when the expansion is completed.

Likewise, the expansion start timing and the expansion completion timing of the first operating chamber V1 coincides with those of the second operating chamber V2 such that the pressures in the first and second operating chambers V1, V2 are approximately equal. Furthermore, the volumes of the first and second operating chambers V1, V2 are also approximately equal, when the pressures in the first and second operating chambers V1, V2 are leveled. As a result, the expansion operation can be performed very efficiently.

In the present embodiment, the expansion starting timing of the first operating chamber V1 accurately coincides with that of the second operating chamber V2. However, the expansion starting timing of the first operating chamber V1 may generally synchronized with that of the second operating chamber V2 in order to achieve sufficient efficiency improvement of the expansion operation. An operational state, where the expansion starting timing of the first operating chamber V1 generally synchronizes with that of the second operating chamber V2, means that difference of the expansion starting timing between the first and second operating chambers V1, V2 may correspond to a rotation angle of the revolving scroll 103 by 45 degree or less and may preferably correspond to that by 30 degree or less. The rotation angle of the revolving scroll 103 by 10 degree or less may be more preferable for this operational state.

In the present embodiment, the operating chamber V is divided into the first operating chamber V1 and the second operating chamber V2 and the expansion of the first and second operating chambers V1, V2 is started to develop when a volume of a newly formed operating chamber V at the scroll center portion becomes a positive value from zero. However, the expansion of the first and second operating chambers V1, V2 may be alternatively started when the newly formed operating chamber V communicates with the introducing port 105*a* and at the same time the volume of the operating chamber V is less than a predetermined value (is preferably a minimum value).

A depth of the recess portion 1031 formed at the tooth portion 103*b* of the revolving scroll 103 may be preferably similar to a depth of an extending portion of the communication passage 105 inside the tooth portion 102*b* in order to achieve sufficiently balanced expansion operation of the first and second operation chambers V1, V2. However, the depth of the recess portion 1031 and the communication passage 105 may be determined in a different manner. Because the fluid machine of the present embodiment is the expander-integrated compressor 10, a compression operation is conducted using the expander-integrated compressor 10. Thus, the communication passage 105 and the recess portion 1031 may be considered to be dead volumes in the compression operation. Thus, any depth of the recess portion 1031 and the communication passage 105 may alternatively be determined as any length as long as sectional areas of the refrigerant passages (the recess portion 1031 and the communication passage 105) are adequately formed such that the refrigerant passages may be limited from causing the disadvantageous pressure loss even with a maxim flow of the refrigerant in the expansion operation.

The contact portion and the sliding contact portion in the present embodiment include not only an exact meaning of contact but also a slight clearance for easily enabling the revolving action of the scroll. In other words, the definition of "contact" in the context of the contact portion or the sliding contact portion does not have to mean that two parts exactly contact with each other, or two parts exactly slidingly contact with each other, but may alternatively mean that two parts are located adjacently enough to define operating chambers (i.e., the operating chambers are sealed such that each operating chamber is effectively formed). The generally contact portion or the generally sliding contact portion, which includes the slight clearance, may be substantially the contact portion or the sliding contact portion.

Modifications of the embodiment will be described. In the above-described embodiment, the section shape of the recess portion 1031, which serves as the passage portion, is the arc shape, however the section shape is not so limited.—

Figure 9A:
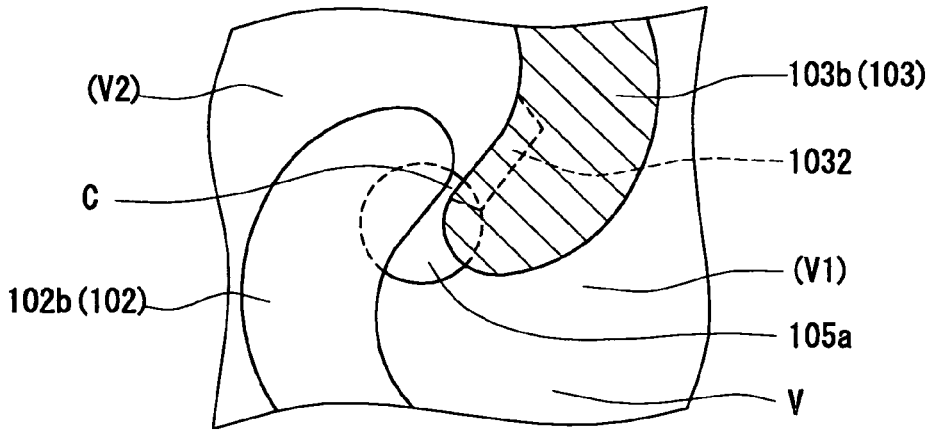
FIG. 9A is an enlarged sectional view of a center portion of scrolls, showing an operational state where an operating chamber approaches to be divided, and where the refrigerant is introduced to the operating chamber.
Figure 9B:
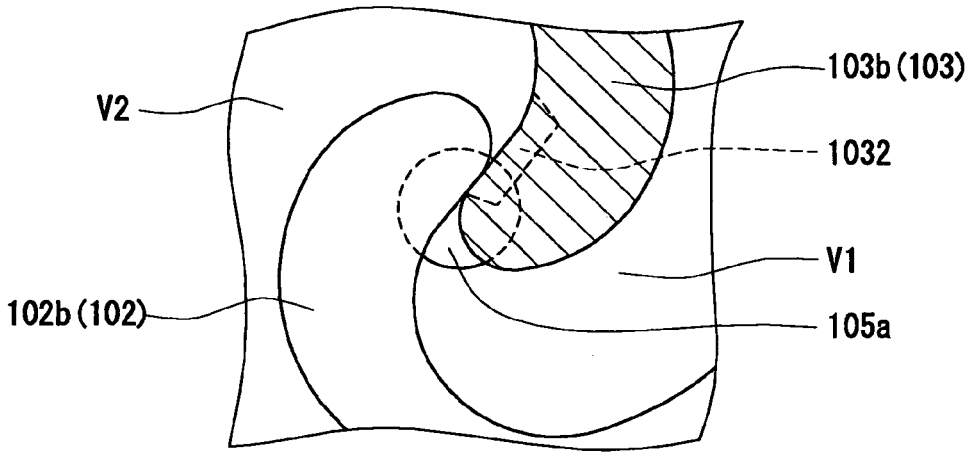
FIG. 9B is an enlarged sectional view of a center portion of scrolls, showing an operational state where the operating chamber is divided into two operating chambers, and where the refrigerant is introduced to the two operating chambers.
Figure 9C:
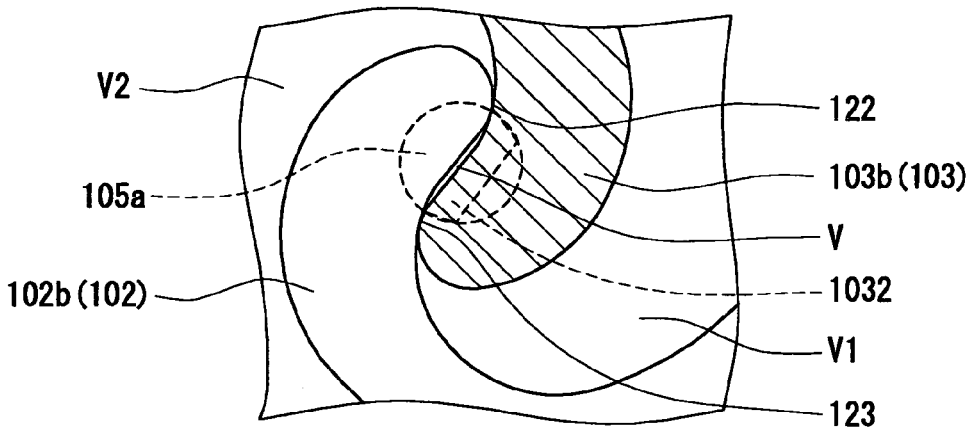
FIG. 9C is an enlarged sectional view of a center portion of scrolls, showing an operational state where an introduction of the refrigerant to the two operating chambers is ended.

For example, the tooth portion 103*b* of the revolving scroll 103 may alternatively include a recess portion 1032, which is formed into an elongated recess shape (e.g., a rectangular parallelepiped or a rectangular cone) as shown in FIG. 9A to FIG. 9C. In this structure, by the recess portion 1032, approximately the same amounts of the refrigerant can be introduced to the first and second operating chambers V1, V2 when the tooth portions 102*b*, 103*b* are positioned adjacent to each other as shown in FIG. 9A and right before a state shown in FIG. 9B, where a new operating chamber V is formed in the same manner as the recess portion 1031 shown in FIGS. 7A, 7B does in the above-described embodiment. Also at the same time, by the recess portion 1032, the refrigerant introduction ending timing (expansion starting timing) of the first operating chamber V1 can be made to synchronize with that of the second operating chamber V2 as shown in FIG. 9C.

Also, the passage portion provided on the tooth portion 103*b* may not be limited to a recess shape.

Figure 10:
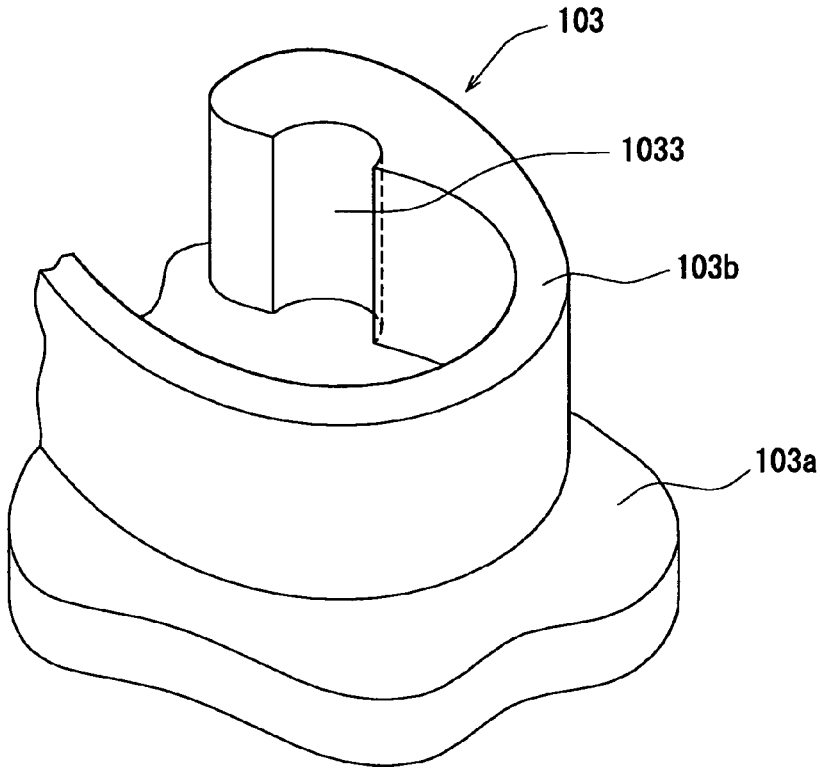
FIG. 10 is a perspective view of a spiral end portion on a center side of a tooth portion of a revolving scroll in one modification example of the embodiment.
Figure 11:
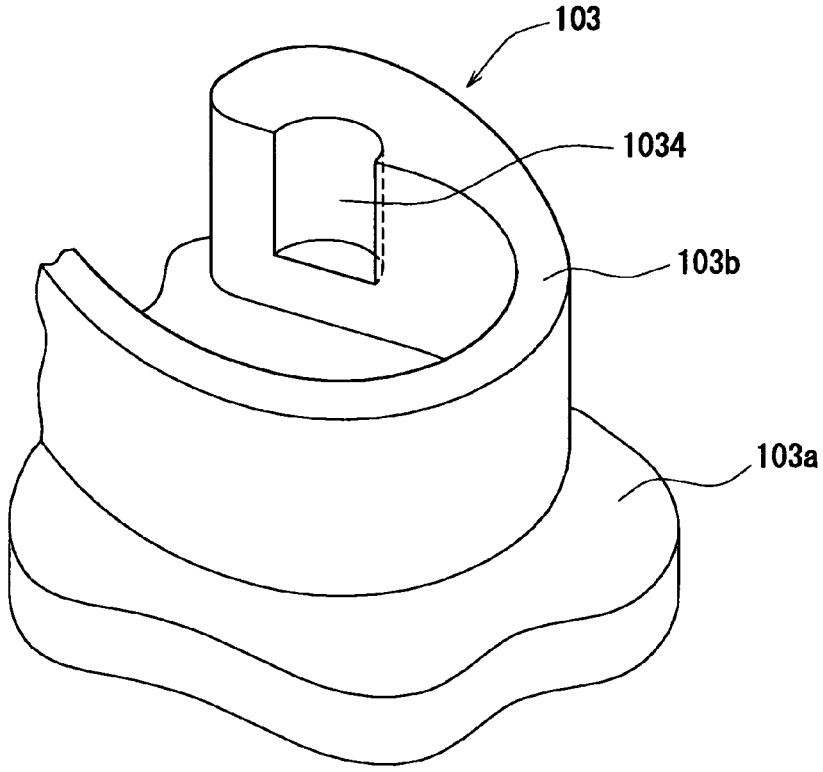
FIG. 11 is a perspective view of a spiral end portion on a center side of a tooth portion of a revolving scroll in another modification example of the embodiment.

In the above-described embodiment, the recess portion 1031 is formed at the side surface portion of the tooth portion 103*b* of the revolving scroll 103 and is located off the tip end portion of the tooth portion 103*b* in the tooth extending direction. However, for example, a recess portion may alternatively be located on the tip end portion of the tooth portion 103*b* in the tooth extending direction of the revolving scroll 103 similarly to recess portions 1033, 1034 as shown in FIGS. 10, 11. It is easy to form the passage on the tooth portion 103*b*, because tooth portion 103*b* can be easily machined on the tip end portion in the tooth extending direction thereof to form the recess portion.

Also, in the above-described embodiment, the introducing port 105*a* extends from the base portion 102*a* to the tooth portion 102*b* of the stationary scroll 102. However, the introducing port 105*a* may alternatively be formed at a generally center of the stationary scroll 102. For example, the introducing port 105*a* may open at the generally center of the stationary scroll 102 only on the base portion 102*a* as shown in FIG. 12.

Figure 12:
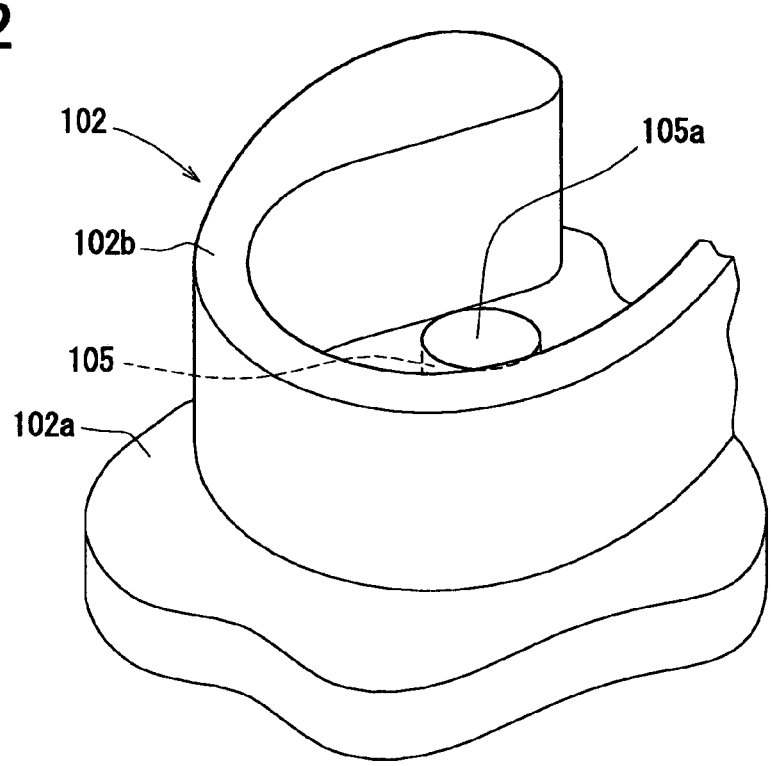
FIG. 12 is a perspective view of a spiral end portion on a center side of a stationary scroll in another modification example of the embodiment.

When the introducing port 105*a* is opened at the position shown in FIG. 12, the revolving scroll 103 that has either the recess portion 1033 or the recess portion 1034 shown in FIGS. 10, 11 may be engaged (combined). Here, the recess portions 1033, 1034 extend up to an edge of the end portion of the tooth portion 103*b* in the tooth extending direction.

Also, in the above-described embodiment, the recovered power, which is recovered by the expander-integrated compressor 10 is stored in the battery. However, the recovered power may be alternatively stored as a mechanical energy, such as a kinetic energy by use of a flywheel and a resilient energy by use of a spring.

Further, in the above-described embodiment, the speed changing mechanism 400 includes the planetary gear mechanism. However, the speed changing mechanism 400 may be an alternative speed changing mechanism that can shift a transmission gear ratio, such as a belt-type continuously variable transmission (CVT) and a toroidal-type speed changing mechanism, which does not utilize the belt. Also, the present invention may be applied to an expander-integrated compressor that does not include a speed changing mechanism.

Figure 13:
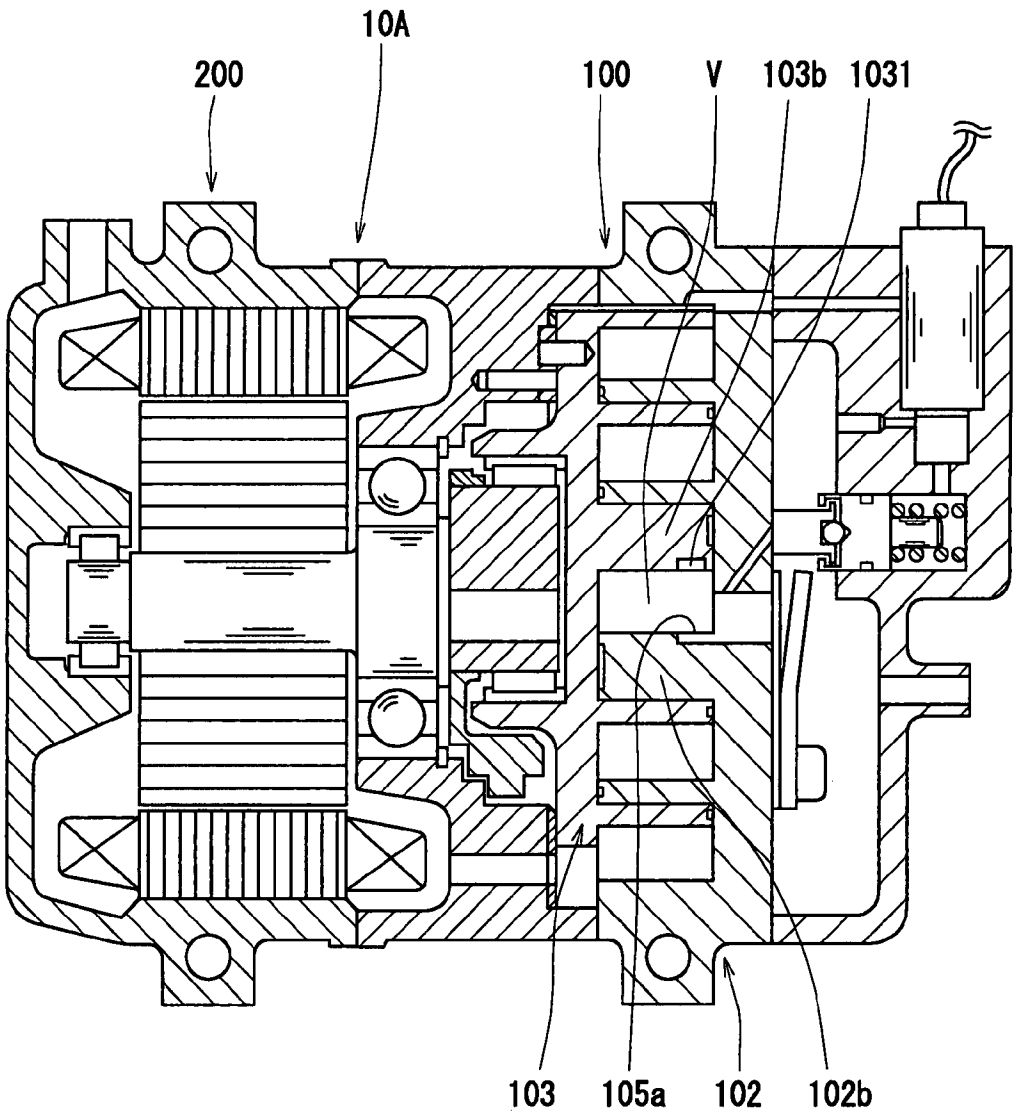
FIG. 13 is a sectional view showing an expander-integrated compressor in another modification example of the embodiment.

Also, the present invention may be applied to an expander-integrated compressor that does not include an external driving source, such as the engine 20. For example, the present invention may be applied to an expander-integrated electrically-driven compressor 10A such that when the rotation electrical device 200 is driven, the compression operation is performed by the pump motor mechanism 100, and such that when the expansion operation is performed by the pump motor mechanism 100, the electric power is generated by the rotation electrical device 200 as shown in FIG. 13.

The fluid machine of the present invention is not limited to the expander-integrated compressor, however the fluid machine may be an expander, which does not includes a compressor.

The fluid machine of present invention is applied to the vapor-compression type refrigerating system with the Rankine cycle for a vehicle. However, the fluid machine of the present invention is not so limited and can be applied for the other use.

Additional advantages and modifications will readily occur to those skilled in the art. The invention in its broader terms is therefore not limited to the specific details, representative apparatus, and illustrative examples shown and described.

What is claimed is:

1. A fluid machine comprising:

a stationary scroll member that includes a first base portion, and a first tooth portion extending from the first base portion in an extending direction to have a spiral shape; and a movable scroll member that includes a second base portion, and a second tooth portion extending from the second base portion in a direction opposite to the extending direction of the first tooth portion to have a spiral shape, wherein:

the second tooth portion of the movable scroll member is arranged to be revolved with respect to the first tooth portion of the stationary scroll member and to form an operating chamber between the movable scroll member and the stationary scroll member, the operating chamber is changeable in accordance with a revolution of the movable scroll member to be defined between two sliding contact portions between the first and second tooth portions, and is dividable into a first operating chamber and a second operating chamber when a spiral end portion of the first tooth portion contacts a spiral end portion of the second tooth portion approximately at a center portion of the movable scroll member;

the stationary scroll member has an introducing port for introducing a fluid to the operating chamber at a center portion of the stationary scroll member;

the second tooth portion is provided with a passage portion through which the introducing port communicates with the second operating chamber when the introducing port communicates with the first operating chamber;

the passage portion disconnects the introducing port from the second operating chamber when the introducing port is disconnected from the first operating chamber; and the volumes of the first and second operating chambers are approximately equal when the pressure in the first and second operating chambers are leveled.

2. The fluid machine according to claim 1, wherein the passage portion is provided such that a flow resistance of the fluid between the introducing port and the first operating chamber is approximately equal to that between the introducing part and the second operating chamber when the introducing port communicates with the first operating chamber.

3. The fluid machine according to claim 1, wherein:

the passage portion is provided at the second tooth portion and extends in the extending direction of the second tooth portion; and the passage portion is spaced from a tip end portion of the second tooth portion in the extending direction of the second tooth portion.

4. The fluid machine according to claim 1, wherein:

the passage portion is formed on the second tooth portion and extends in the extending direction of the second tooth portion; and the passage portion is located at a tip end portion of the second tooth portion in the extending direction of the second tooth portion.

5. The fluid machine according to claim 1, wherein the movable scroll member is revolved relative to the stationary scroll member in a first rotation direction to perform an expansion-mode operation, in which the operating chamber is divided into the first and second operating chambers, which are expanded radially outwardly.

6. The fluid machine according to claim 5, wherein the movable scroll member is revolved relative to the stationary scroll member in a second rotation direction opposite to the first rotation direction to perform a compression-mode operation, in which divided first and second operating chambers are displaced radially toward the center portion of the stationary scroll member to compress the fluid.

7. The fluid machine according to claim 5, wherein, in the expansion-mode operation, the volumes of the first and second operating chambers are approximately equal when the pressure in the first and second operating chambers are leveled.

8. The fluid machine according to claim 1, wherein:

the second tooth portion has a spiral inner surface; and the passage portion is a recess recessed from the spiral inner surface.

9. The fluid machine according to claim 1, wherein the passage portion is provided at the spiral end portion of the second tooth portion.

10. The fluid machine according to claim 1, wherein a section of the passage portion perpendicular to the extending direction of the second tooth portion has an arc shape.

11. The fluid machine according to claim 1, wherein the movable scroll member is revolved relative to the stationary scroll member to perform an expansion-mode operation such that an expansion start timing and an expansion completion timing of the first operating chamber coincide with those of the second operating chamber such that the pressures in the first and second operating chambers are approximately equal.

12. The fluid machine according to claim 1, wherein the passage portion is semi-cylindrical in shape.

13. The fluid machine according to claim 1, wherein at least part of the passage portion faces and overlaps with a part of the introducing port such that the passage portion communicates with the introducing port at least temporarily during operation of the fluid machine.

14. The fluid machine according to claim 1, wherein:

at least part of the introducing port is formed in a side wall of the first tooth portion;

the passage portion is formed in a side wall of the second tooth portion;

the part of the introducing port and the passage portion face generally toward one another.

15. The fluid machine according to claim 1, wherein the passage portion is formed in a side wall of the second tooth portion and is spaced from an end of the second tooth portion in a longitudinal direction of the second tooth portion.

16. The fluid machine according to claim 1, wherein the passage portion is formed in a wall of the second tooth portion and is spaced apart from the second base portion.

17. The fluid machine according to claim 1, wherein the movable scroll member is driven relative to the stationary scroll member by the fluid, which enters the first and second operating chambers through the introducing port and through the passage portion, which are constructed and arranged to communicate with one another, to cause the first and second operating chambers to expand radially in an outward direction.

* * * * *